US007345570B2

(12) United States Patent
Kawanishi

(10) Patent No.: US 7,345,570 B2
(45) Date of Patent: Mar. 18, 2008

(54) THERMOPROTECTOR

(75) Inventor: Toshiro Kawanishi, Osaka (JP)

(73) Assignee: Uchihashi Estec Co., Ltd., Osaka (JP)

( * ) Notice: Subject to any disclaimer, the term of this patent is extended or adjusted under 35 U.S.C. 154(b) by 260 days.

(21) Appl. No.: 11/194,929

(22) Filed: Aug. 2, 2005

(65) Prior Publication Data

US 2007/0030110 A1 Feb. 8, 2007

(51) Int. Cl.
*H01H 85/36* (2006.01)
*H01H 85/044* (2006.01)

(52) U.S. Cl. ..... 337/142; 337/407; 337/414

(58) Field of Classification Search ..... 337/36, 337/4, 401, 405–407, 147, 148, 152, 142, 337/414
See application file for complete search history.

(56) References Cited

U.S. PATENT DOCUMENTS

| | | | | | |
|---|---|---|---|---|---|
| 530,430 | A * | 12/1894 | Klein | 337/403 |
| 2,790,049 | A * | 4/1957 | McAlister | 337/405 |
| 3,198,914 | A * | 8/1965 | Baran et al. | 337/405 |
| 3,420,217 | A * | 1/1969 | Powell et al. | 123/198 D |
| 3,638,083 | A * | 1/1972 | Dornfeld et al. | 361/321.1 |
| 3,780,327 | A * | 12/1973 | Vervaart et al. | 313/151 |
| 4,383,236 | A * | 5/1983 | Urani et al. | 337/403 |
| 4,441,093 | A * | 4/1984 | Okazaki | 337/404 |
| 4,536,641 | A * | 8/1985 | Chan | 219/253 |
| 5,192,937 | A * | 3/1993 | Lee | 337/104 |
| 5,280,262 | A * | 1/1994 | Fischer | 337/405 |
| 5,363,083 | A * | 11/1994 | Fischer | 337/407 |
| 5,600,295 | A * | 2/1997 | Kaufmann | 337/405 |
| 5,612,662 | A * | 3/1997 | Drekmeier et al. | 337/389 |
| 5,770,993 | A * | 6/1998 | Miyazawa et al. | 337/160 |
| 5,793,274 | A * | 8/1998 | Kelly et al. | 337/183 |
| 5,896,080 | A * | 4/1999 | Chen | 337/407 |
| 6,204,747 | B1 * | 3/2001 | Kitchens | 337/407 |
| 6,342,827 | B1 * | 1/2002 | Buhrend et al. | 337/365 |
| 6,348,851 | B1 * | 2/2002 | Wyser et al. | 337/411 |
| 7,023,674 | B2 * | 4/2006 | Gross et al. | 361/23 |

FOREIGN PATENT DOCUMENTS

| | | | |
|---|---|---|---|
| GB | 2077500 A | * | 12/1981 |
| JP | 01057546 A | * | 3/1989 |
| JP | 7-29481 | | 1/1995 |
| WO | WO 87/02835 A1 | * | 5/1987 |

* cited by examiner

*Primary Examiner*—Anatoly Vortman
(74) *Attorney, Agent, or Firm*—Lucas & Mercanti, LLP

(57) ABSTRACT

In the thermoprotector of the invention, an elastic movable conductor 3 is placed between stationary electrodes 21, 22 opposed in an insulation housing 1. One end of the elastic movable conductor 3 is fixed to one stationary electrode 21. The elastic movable conductor 3 is compressed in a longitudinal direction and elastically curved to cause a middle of the elastic movable conductor 3 to be contacted with the other stationary electrode 22. Another end portion of the elastic movable conductor 3 is face joined by a fusible material 4 to the one stationary electrode 21 against a reaction force of the longitudinal direction compression. An insulation spacer 5 is disposed in the insulation housing 1. The insulation spacer forms a space for housing the other end portion of the elastic movable conductor 3 when the elastic movable conductor 3 is elastically released by melting of the fusible material 4.

36 Claims, 6 Drawing Sheets

THERMOPROTECTOR

BACKGROUND OF THE INVENTION

1. Field of the Invention

The present invention relates to a thermoprotector in which the melting point or the softening point of a fusible material is set as the operating temperature.

2. Explanation of Related Art

As a thermoprotector which senses abnormal heating of an electrical or electronic apparatus, and which performs a cut-off operation based on this sense to interrupt the apparatus from a power supply, thereby preventing overheat of the apparatus and occurrence of a fire, a device which operates on the basis of the melting point or softening of a fusible material is known.

Such a thermoprotector has the following basic structure. A movable electrode and a stationary electrode are in contact with each other in a state where elastic distortion energy is stored, the elastic distortion energy is constrained by a fusible member, and, when the fusible member is melted or softened, the elastic distortion energy is released to cause an elastic movable conductor to separate from the stationary electrode.

FIGS. 8 to 10 show examples of such a thermoprotector.

In a thermoprotector shown in FIG. 8, an elastic metal piece 3' is elastically bent as shown in (8A) of FIG. 8, the both ends of the elastic metal piece 3' are bonded against a bending reaction force to a pair of stationary electrodes 41', 42' by an fusible alloy (solder) 4' having a predetermined melting point. When the ambient temperature is raised to the melting point of the fusible alloy 4' and the fusible alloy is melted, elastic bending distortion energy of the elastic metal piece 3' is released to cancel the joining between one end of the elastic metal piece 3' and the one stationary electrode 42' as shown in (8B) of FIG. 8, thereby interrupting the power supply (see Japanese Patent Application Laying-Open No. 7-29481).

In a thermoprotector shown in FIG. 9, as shown in (9A) of FIG. 9, a pellet 2' having a predetermined melting point, a seat plate 15', a compression spring 1', and a seat plate 16' are sequentially housed in a metal case 14' to which a lead terminal 13' is attached at one end, with starting from the one end. Furthermore, a movable electrode 42' in which the outer circumference is in sliding contact with the inner face of the metal case is housed in the case, a lead pin bushing 17' is fixed to the other end side of the metal case 14', and a trip spring 18' is incorporated between the bushing 17' and the movable electrode 42', thereby constituting a conduction path passing the route of the lead terminal 13'→the metal case 14'→the movable electrode 42'→a lead pin 41'. When the ambient temperature is raised to the melting point of the pellet 2' and the pellet 2' is melted, compression stress of the compression spring 1' is released, and the movable electrode 42' is detached from the tip end of the lead pin 41' by compression stress of the trip spring 18' as shown in (9B) of FIG. 9, thereby interrupting the conduction path (see "ELECTRICAL ENGINEERING HANDBOOK" First Edition, The Institute of Electrical Engineers of Japan, Feb. 28, 1988, p. 818).

In a thermoprotector shown in FIG. 10, an elastic movable conductor is elastically flexed by a vertical force due to attachment of a fusible material spacer to be contacted with a stationary electrode as shown in (10A) of FIG. 10, and elastic distortion energy of the elastic movable conductor is released by melting or softening of the fusible material spacer, whereby the elastic movable conductor is detached from the stationary electrode as shown in (10B) of FIG. 10 to interrupt the power supply.

In the thermoprotector shown in FIG. 8, however, the bending reaction force M' and an n-direction expanding force F' of the elastic metal piece act on the fusible alloy (solder). Therefore, the stress distribution in the fusible alloy is complicated, and stress acts on a local portion, so that stress concentration inevitably occurs and an operation failure due to creep easily occurs. Since the fusible alloy forms a part of a conduction path, the fusible alloy may generate heat because of an increase of the resistance due to creep of the fusible alloy, thereby causing a possibility that an operation error may be caused by self-heating. Furthermore, an operation error may be caused also by stringing of the molten alloy.

In the thermoprotector shown in FIG. 9, the pellet can be uniformly compressed by pressure equalization of the seat plates, but the structure is complicated. Therefore, the thermoprotector is inevitably disadvantageous in miniaturization and cost.

In the thermoprotector shown in FIG. 10, the elastic movable conductor is caused by the vertical force to be contacted with the stationary electrode, and the contact is cancelled in the vertical direction. Therefore, a space for installing the fusible material spacer must be disposed in the vertical direction, and therefore this stricture is disadvantageous in low-profiling of a thermoprotector.

SUMMARY OF THE INVENTION

It is an object of the invention to provide a thermoprotector in which a stationary electrode and an elastic movable conductor are housed in an insulation housing, the elastic movable conductor is elastically distorted to be contacted with the stationary electrode, the elastic distortion state of the elastic movable conductor is held by a fusible material, and the elastic distortion of the elastic movable conductor is released by melting or softening of the fusible material, thereby causing the elastic movable conductor to be detached from the stationary electrode, and which can operate stably and smoothly, has a reduced number of components and is easily produced, and is easily low-profiled.

In the thermoprotector of the invention, an elastic movable conductor is placed between stationary electrodes opposed in an insulation housing, one end of the elastic movable conductor is fixed to one of the stationary electrodes, the elastic movable conductor is compressed in a longitudinal direction and elastically curved to cause a middle of the elastic movable conductor to be contacted with another one of the stationary electrodes, another end portion of the elastic movable conductor is face joined by a fusible material to the one stationary electrode against a reaction force of the longitudinal direction compression, and an insulation spacer is disposed in the insulation housing, the insulation spacer forming a space for housing the other end portion of the elastic movable conductor when the elastic movable conductor is elastically released by melting of the fusible material.

In the thermoprotector of the invention, an elastic movable conductor is placed between stationary electrodes opposed in an insulation housing, the elastic movable conductor is compressed in a longitudinal direction and elastically curved to cause a middle of the elastic movable conductor to be contacted with another one of stationary electrodes, both end portions of the elastic movable conductor are face joined by a fusible material to one of the stationary electrodes against a reaction force of the longitudinal direction compression, and an insulation spacer is disposed in both ends of an interior of the insulation housing, the insulation spacer forming a space for housing the end portions of the elastic movable conductor when the elastic movable conductor is elastically released by melting of the fusible material.

In the thermoprotector of the invention, an elastic movable conductor which is a tip end portion of a lead wire, and a stationary electrode are opposedly placed in an insulation housing, the elastic movable conductor is compressed in a longitudinal direction and elastically curved to cause a middle of the elastic movable conductor to be contacted with the stationary electrode, a tip end portion of the elastic movable conductor is face joined by a fusible material to the stationary electrode against a reaction force of the longitudinal direction compression, and an insulation spacer is disposed in both ends of an interior of the insulation housing, the insulation spacer forming a space for housing the tip end portion of the elastic movable conductor when the elastic movable conductor is elastically released by melting of the fusible material.

In the thermoprotector, the insulation spacer has a hole notch which receives a curved deformed portion of the fusible material, and an outer circumference of the insulation spacer is in close proximity to an inner circumference of the insulation housing.

In the thermoprotector, the fusible material is a fusible alloy.

In the thermoprotector, the fusible material is a thermoplastic resin.

In the thermoprotector, the elastic movable conductor is a single elastic metal, a composite material of an elastic metal and a resin, or a composite material of an elastic resin and a metal.

In the thermoprotector of the invention, the joining between the end portion of the elastic movable conductor and the stationary electrode or the inner face of the insulation housing is performed by means of a face so that elastic distortion energy applied to the elastic movable conductor is supported by the joining face and only a shearing force mainly acts on the joining face. Therefore, the stress distribution of the fusible material in the joining interface can be formed as a uniform shearing stress distribution. As a result, a creep due to stress concentration in the fusible material can be satisfactorily prevented from occurring, and an operation error caused by a creep in the fusible material can be eliminated, whereby a long-term stability can be ensured.

In the thermoprotector of the invention, the released end of the elastic movable conductor which is released from elastic bending distortion by melting of the fusible material is received by a space immediately below the insulation spacer. Therefore, the movable conductor can be prevented from being recontacted with the stationary electrode, and sure interruption can be attained.

In a secondary battery of a high energy density such as a lithium-ion secondary battery or a lithium polymer secondary battery, the temperature of heat generation in the case of occurrence of abnormality is high because of its high energy density. Therefore, a thermoprotector which senses the heat generation, and which interrupts the energization by the battery is necessary. The thermoprotector of the invention can be easily low-profiled, and can be satisfactorily incorporated in a battery pack. Consequently, the thermoprotector can be preferably used as a battery thermoprotector.

DESCRIPTION OF THE PREFERRED EMBODIMENTS

Figure 1:
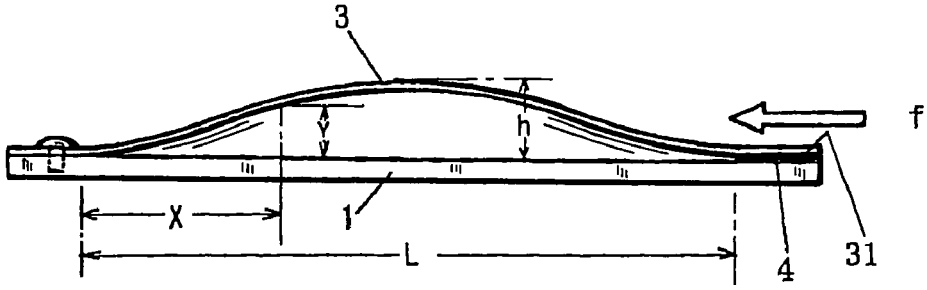
FIG. 1 is a view showing dynamic behavior of an elastic movable conductor used in the thermoprotector of the invention.

FIG. 1 is a view showing the basic structure of the thermoprotector of the invention.

Referring to FIG. 1, 1 denotes a base, and 3 denotes an elastic movable conductor. One end portion of the elastic movable conductor is fixed in parallel to a face of the base. In a state where the other end portion of the elastic movable conductor is contacted in parallel to the base face, a longitudinal load f is caused to act on the other end portion of the elastic movable conductor, thereby applying elastic bending distortion energy. While applying the elastic bending distortion energy, the other end portion of the elastic movable conductor 3 is face joined by a fusible material 4 to the base face.

In the thermoprotector, when the external temperature is raised and the fusible material 4 is melted or softened, a joining interface 31 is detached, and the elastic bending distortion energy is released so that the elastic movable conductor is restored to the original linear shape.

Referring to FIG. 1, in the case where the other end portion of the elastic movable conductor 3 is not fixed, when the longitudinal load f exceeds $4\pi^2EI/L^2$ (L is the length of the elastic movable conductor), buckling occurs from Euler's theory. Namely, when the load is equal to or larger than the Euler load, the work $f\Delta\lambda$ ($\Delta\lambda$ is the movement distance of the other end of the elastic movable conductor) done by the longitudinal load f exceeds the bending distortion energy of the elastic movable conductor 3, and the system is so unstable that buckling occurs.

In a stable system where buckling does not occur, when the bending shape y of the elastic movable conductor is approximately set to:

$$y=h(1-\cos 2\pi x/L)/2,$$

the pressing amount $\Delta\lambda$:

$$\Delta\lambda = \int_0^L 1/2\cdot(dy/dx)^2 dx \qquad \text{[Ex. 1]}$$

is given by $\Delta\lambda=\pi^2h^2/(4L)$.

From the expression of $$h=2(\Delta\lambda\cdot L)^{1/2}/\pi,$$

a predetermined bending height h can be set by adjusting the pressing amount $\Delta\lambda$.

Referring to FIG. 1, when the fusible material 4 reaches the melting point or the softening point, the bending height h of the elastic movable conductor 3 becomes zero, the other end of the elastic movable conductor is outward moved by $\Delta\lambda$, and the elastic movable conductor is restored to the original linear shape.

In the above, the main force acting on the joining interface 31 between the other end portion of the elastic movable conductor and the base face is a shearing force f, and, when the area of the joining interface is indicated by S, shearing stress $\tau$ of the joining interface with respect to the shearing force f is given by:

$$\tau=f/S.$$

A bending reaction force which acts on the joining interface between the other end portion of the elastic movable conductor and the base face will be discussed. The other end portion of the elastic movable conductor is fixed with a flexure angle of substantially zero. The bending reaction force can be limited to a small degree, and stress of the joining face with respect to the bending reaction force can be dispersed to the boding area S. Therefore, the bending reaction can be restricted to a very small degree.

With respect to the shearing force $\tau$=f/S of the joining interface, the shearing strength of the joining interface must exceed f/S. The shearing strength must be provided with a sufficient safety factor. Therefore, preferably, a hole, a recess, or a notch is formed in one or both of the other end portion of the elastic movable conductor and the base face which are to be face joined to each other, and the fusible material is caused to enter the hole or the like, or one or both of the other end portion of the elastic movable conductor and the base face which are face joined to each other are roughened, whereby the shearing strength of the joining interface is enhanced. Alternatively, in order to mechanically reinforce the interface which is face joined by the fusible material, the fusible material may be applied to the tip end face of the elastic movable conductor and the base face.

As the elastic movable conductor 3, a metal, a synthetic resin, or a composite material of a metal and a synthetic resin may be used. Such a composite material may include a resin to which metal powder is mixed. When a material having a high electrical resistance such as a resin to which metal powder is mixed is used as the elastic movable conductor, the protector can be operated by causing the fusible material to be melted by heat generation due to energization of a resistor.

As the fusible material 4, a fusible alloy such as solder, a single metal, a thermoplastic resin, or a conductive thermoplastic resin to which conductive powder is added may be used.

In FIG. 1, the one end portion of the elastic movable conductor is fixed, and only the other end portion of the elastic movable conductor is face joined to the base face by the fusible material. Alternatively, both the ends of the elastic movable conductor may be face joined to the base face by the fusible material.

Figure 2A:
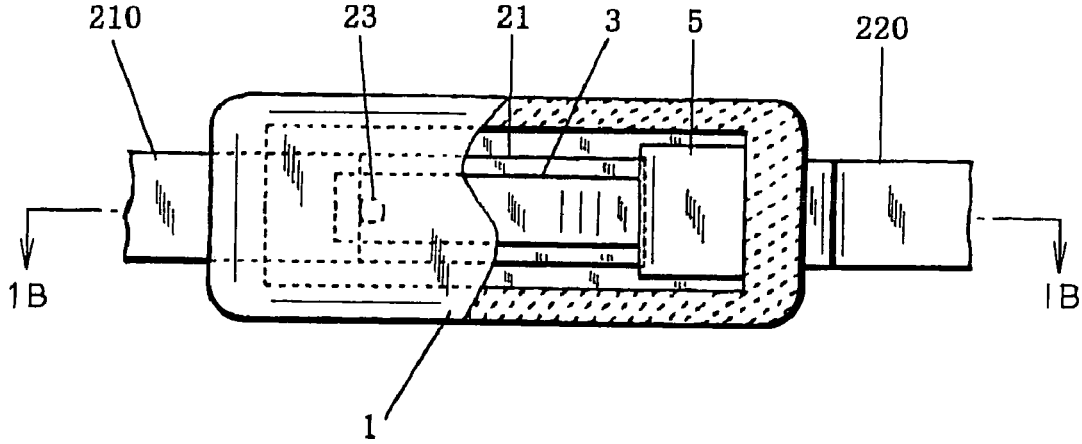
FIG. 2 is a view showing an embodiment of the thermoprotector of the invention.
Figure 2B:
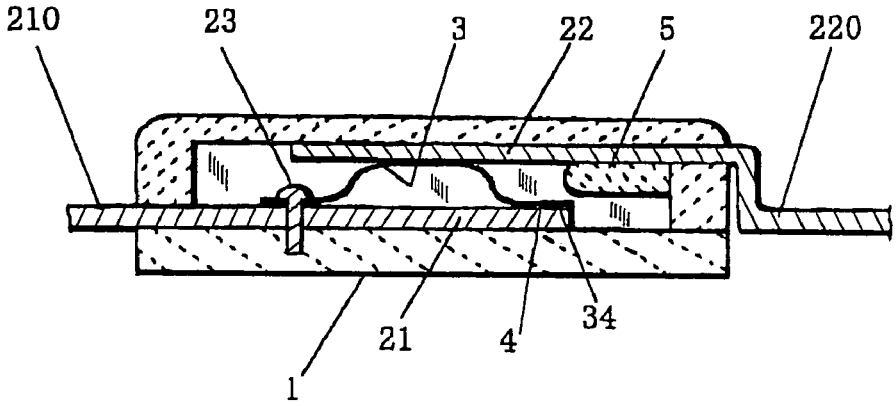

(2A) of FIG. 2 is a plan view of an embodiment of the thermoprotector of the invention, and (2B) of FIG. 2 is a section view taken along the line 2B-2B in (2A) of FIG. 2.

Referring to FIG. 2, 1 denotes an insulation housing which is configured by ceramics, a synthetic resin, or the like, 21 and 22 denote stationary electrodes which are opposed to each other in the insulation housing 1, and which are fixed to the bottom face and the upper face of the insulation housing 1, respectively, and 210 and 220 denote lead portions of the stationary electrodes 21, 22. The reference numeral 3 denotes an elastic movable conductor. One end portion of the elastic movable conductor is face contacted and fixed to the one stationary electrode 21 by a rivet 23 or welding. In this state, the longitudinal load f is applied to the other end portion of the elastic movable conductor 3 to apply the bending distortion energy to the elastic movable conductor 3. In this state, the other end portion of the elastic movable conductor 3 is face contacted, joined, and fixed to the forefront portion of the one stationary electrode 21 by melting and solidification of the fusible material 4 such as a fusible alloy or a thermoplastic resin (the melting temperature of the fusible material is sufficiently lower than the annealing temperature of the elastic movable conductor), thereby causing the bending outer face of the elastic movable conductor 3 to be in contact with the other stationary electrode 22.

The reference numeral 5 denotes an insulation spacer for forming a space to receive the other end portion of the elastic movable conductor 3 which is released from a face joint 34 by melting of the fusible material 4. The spacer is disposed by bonding to the inner face to the insulation housing, or by integral molding.

In the thermoprotector, normally, the electrical conduction is made through a path of the one stationary electrode 21→the elastic movable conductor 3→the contact face between the elastic movable conductor 3 and the other stationary electrode 22→the other stationary electrode 22. Since the fusible material 4 is not included in the conduction path, the conductivity of the fusible material 4 does not participate in that of the conduction path.

Figure 3:
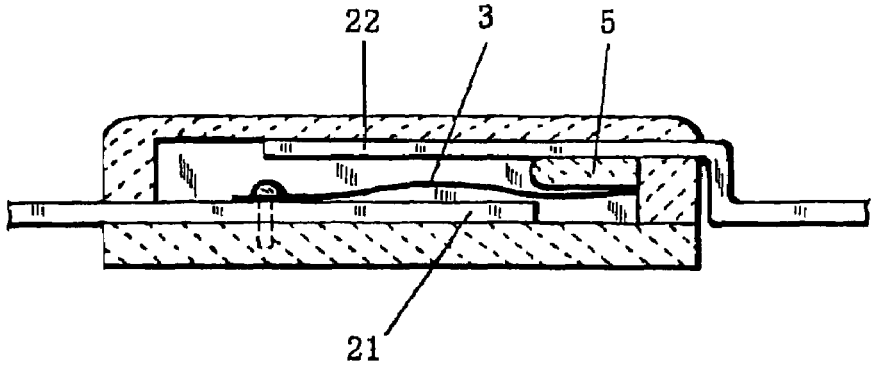
FIG. 3 is a view showing a state of the thermoprotector shown in FIG. 2 after operation.

The operation of the thermoprotector will be described. When the external temperature is raised and the fusible material 4 is heated to the melting point or the softening point, the face joint 34 by the fusible material 4 between the other end portion of the elastic movable conductor 3 and the one stationary electrode 21 is liberated by the bending distortion energy of the elastic movable conductor 3. As shown in FIG. 3, the elastic movable conductor 3 is then restored to the original flat plate-like shape to make the bending height of the elastic movable conductor 3 zero. As a result, the contact between the elastic movable conductor 3 and the other stationary electrode 22 is cancelled, and a non-return conduction cut-off operation is conducted.

In this case, the requirement for starting the operation is that the fusible material is melted or softened and the elastic bending distortion energy of the elastic movable conductor 3 is released. Even when string of the fusible material 4 occurs, therefore, the operation performance is not affected.

The other end portion of the elastic movable conductor 3 which is released from the face joint 34 is housed in a space immediately below the insulation spacer 5, and the elastic movable conductor 3 is prevented from being contacted with the other stationary electrode 22. Therefore, reconduction does not occur, and sure interruption of conduction is ensured.

A contact pressure is applied to the contact face between the bending outer face of the elastic movable conductor 3 and the other stationary electrode 22 in (2B) of FIG. 2 as described later. This is effective in reduction of the contact resistance. In order to further reduce the contact resistance, the contact face may be bonded by solder which is lower in melting point than the fusible material. In this case, in order to suppress string, the layer of the low-melting point solder is preferably made sufficiently thin.

The thermoprotector shown in FIG. 2 is produced in the following manner. The one stationary electrode is placed on the base of the insulation housing, the elastic movable conductor is placed on the stationary electrode, and the one end portion of the elastic movable conductor and the stationary electrode are fixed by a rivet or the like to the base of the insulation housing. Then, the longitudinal load f is applied to the elastic movable conductor to give the bending distortion energy to the elastic movable conductor. In this state, the contact interface between the other end portion of the elastic movable conductor and the tip end side of the one stationary electrode is joined and fixed by melting and solidification of the fusible material such as a fusible alloy or a thermoplastic resin. Thereafter, the other stationary electrode is fixed, the insulation housing body to which the insulation spacer is attached is bonded to the base of the insulation housing by fusion bonding, an adhesive agent, or fitting, and the other stationary electrode is contacted with the bent top face of the elastic movable conductor, thereby completing the production.

During the production, in the contact face of the other stationary electrode with the bent top face of the elastic movable conductor, a reaction force f' is generated by bonding of the housing body. However, the reaction force f' can be made sufficiently small because the flexural rigidity EI of the elastic movable conductor is small. Therefore, also the bending moment which acts on the joining face of the fusible material on the basis of the reaction force f' can be made sufficiently small. As a result, the simple uniform shearing stress distribution in the joint face by the fusible material between the other end portion of the elastic movable conductor and the tip end side of the one stationary electrode can be satisfactorily maintained.

Figure 4A:
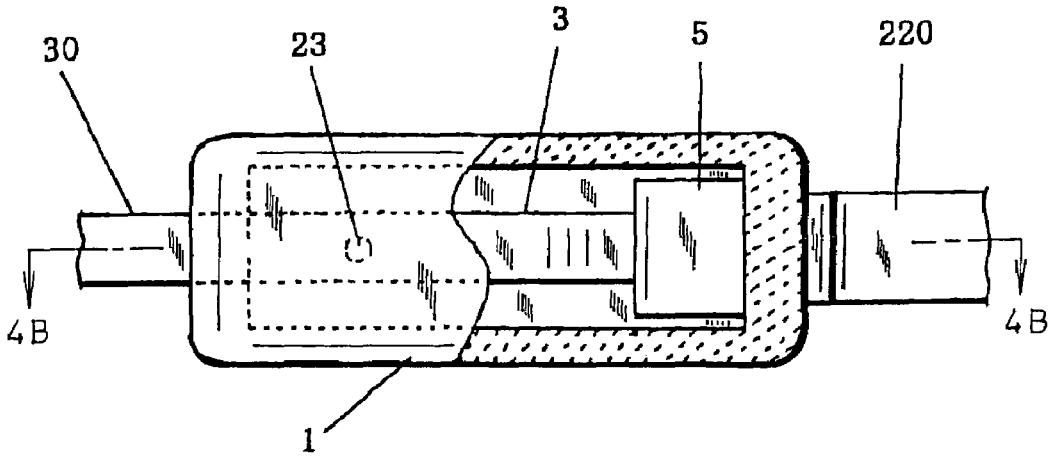
FIG. 4 is a view showing another embodiment of the thermoprotector of the invention.
Figure 4B:
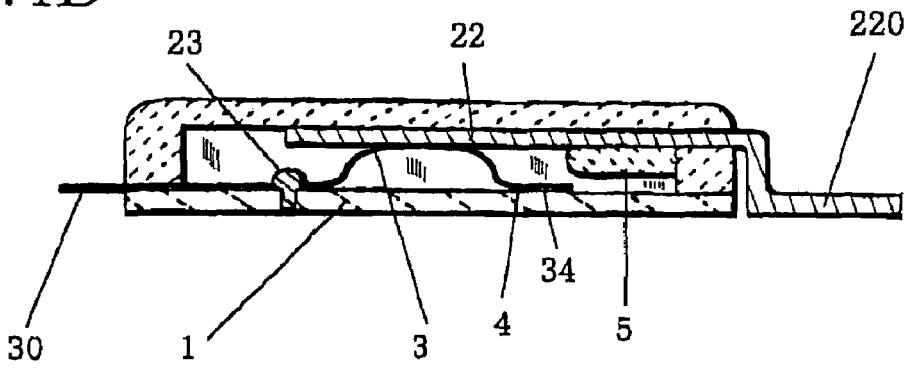

(4A) of FIG. 4 is a plan view illustrating another embodiment of the thermoprotector of the invention, and (4B) of FIG. 4 is a section view taken along the line 4B-4B in (4A) of FIG. 4.

Referring to FIG. 4, 1 denotes a base of an insulation housing which is configured by ceramics, a synthetic resin, or the like, and 30 denotes an elastic lead conductor. A tip end portion of the lead conductor is used as the elastic movable conductor 3, and a place which is separated from the tip end by a predetermined distance is face contacted and fixed to the base face of the insulation housing 1 by a rivet 23 or welding. In this state, the longitudinal load f is applied to the tip end portion of the elastic movable conductor 3 to apply the bending distortion energy to the elastic movable conductor 3. In this state, the tip end portion of the elastic movable conductor 3 is face contacted, joined, and fixed to the base face of the housing 1 by melting and solidification of the fusible material 4 such as a fusible alloy or a thermoplastic resin (the melting temperature of the fusible material is sufficiently lower than the annealing temperature of the elastic lead conductor).

The face-contact welding fixation of the elastic movable conductor 3 to the base face of the insulation housing 1 may be conducted after the base face is metallized by applying and etching of metal foil, or printing and baking of metal powder paste.

The reference numeral 22 denotes a stationary electrode which is contacted with the bent top face of the elastic movable conductor 3, and 220 denotes a lead portion of the stationary electrode 22.

The reference numeral 5 denotes an insulation spacer for forming a space to receive the tip end portion of the elastic movable conductor 3 which is released from the face joint 34 by melting of the fusible material 4. The spacer is disposed by bonding to the inner face to the insulation housing, or by integral molding.

In the thermoprotector, normally, the electrical conduction is made through a path of the lead conductor 30→the contact face of the folded portion of the elastic movable conductor 3 of the lead conductor 30 and the stationary electrode 22→the other lead conductor 220. Since the fusible material 4 is not included in the conduction path, the conductivity of the fusible material 4 does not participate in that of the conduction path.

Figure 5:
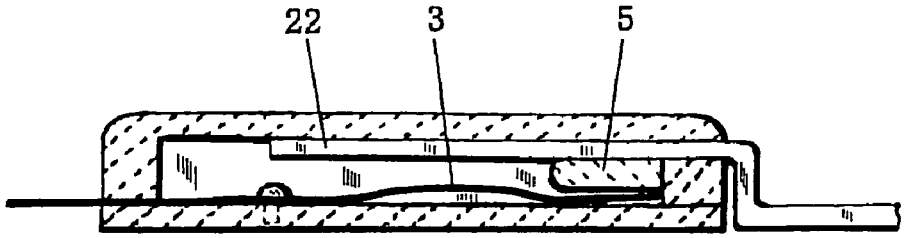
FIG. 5 is a view showing a state of the thermoprotector shown in FIG. 4 after operation.

The operation of the thermoprotector will be described. When the external temperature is raised and the fusible material 4 is heated to the melting point or the softening point, the face joint 34 by the fusible material 4 between the elastic movable conductor 3 and the insulation housing base is liberated by release of the bending distortion energy of the elastic movable conductor 3. As shown in FIG. 5, the elastic movable conductor 3 is then restored to the original flat plate-like shape to make the bending height of the elastic movable conductor 3 zero. As a result, the contact face between the elastic movable conductor 3 and the other stationary electrode 22 is cancelled, and a non-return conduction cut-off operation is completed.

The tip end portion of the elastic movable conductor 3 which is released from the face joint 34 is housed in a space immediately below the insulation spacer 5, and the elastic movable conductor 3 is prevented from being contacted with the stationary electrode 22. Therefore, interruption of conduction is surely realized without occurrence of reconduction.

Figure 6A:
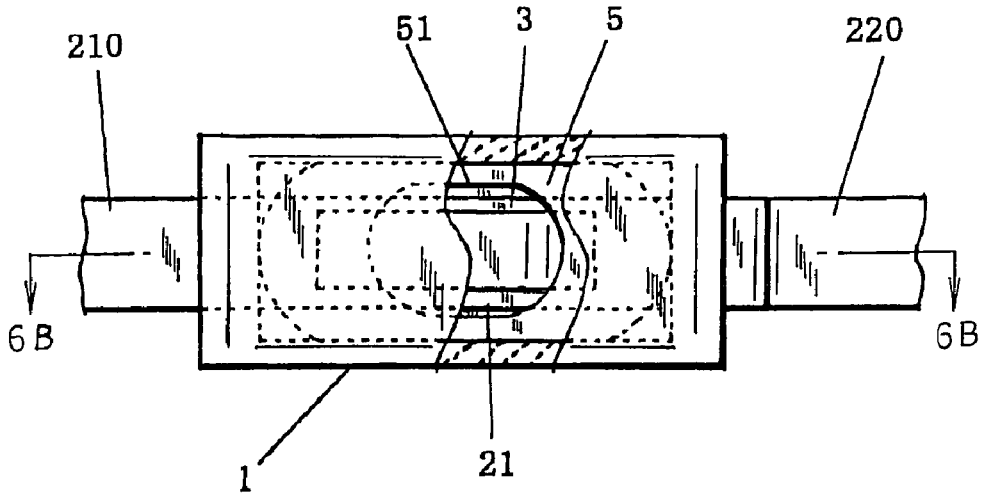
FIG. 6 is a view showing a further embodiment of the thermoprotector of the invention.
Figure 6B:
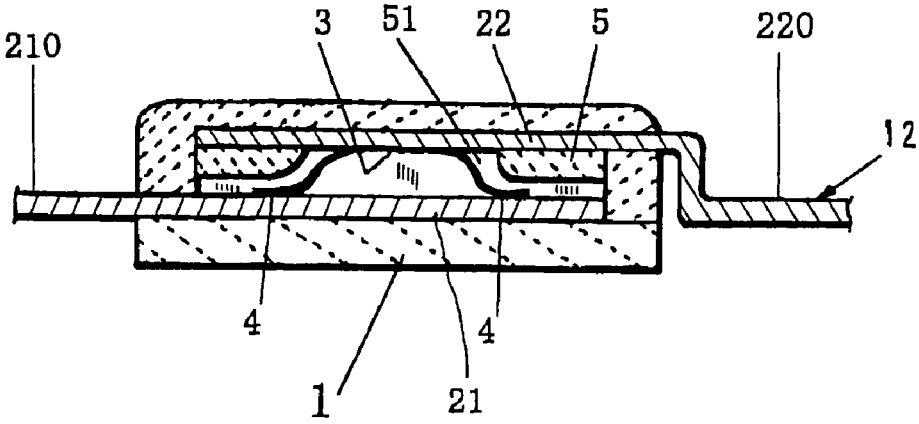

(6A) of FIG. 6 is a plan view illustrating an embodiment of the thermoprotector of the invention, and (6B) of FIG. 6 is a section view taken along the line 6B-6B in (6A) of FIG. 6.

Referring to FIG. 6, 1 denotes an insulation housing which is configured by ceramics, a synthetic resin, or the like, 21 and 22 denote stationary electrodes which are opposed to each other in the insulation housing 1, and which are fixed to the bottom face and the upper face of the insulation housing 1, respectively, and 210 and 220 denote lead portions of the stationary electrodes 21, 22. The reference numeral 3 denotes an elastic movable conductor. The longitudinal load f is applied to give the bending distortion energy to the elastic movable conductor 3. In this state, the both ends of the elastic movable conductor 3 are face contacted, joined, and fixed to the one stationary electrode 21 by melting and solidification of the fusible material 4 such as a fusible alloy or a thermoplastic resin (the melting temperature of the fusible material is sufficiently lower than the annealing temperature of the elastic movable conductor), thereby causing the bending outer face of the elastic movable conductor 3 to be in contact with the other stationary electrode 22.

The reference numeral 5 denotes an insulation spacer for forming a space to receive the both end portions of the elastic movable conductor 3 which are released from a face joint by melting of the fusible material 4. The spacer is formed by fitting an insulation plate in which a hole or notch 51 for receiving the top of a curved portion of the elastic movable conductor is formed, to the inner face of the insulation housing. In place of the insulation plate, the illustrated insulation spacer may be disposed in the both sides in the longitudinal direction of the insulation housing.

In the thermoprotector, normally, the electrical conduction is made through a path of the one stationary electrode 21→the elastic movable conductor 3→the contact face between the elastic movable conductor 3 and the other stationary electrode 22→the other stationary electrode 22.

Figure 7:
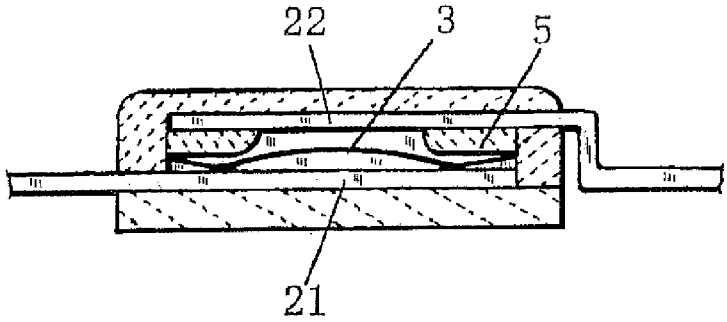
FIG. 7 is a view showing a state of the thermoprotector shown in FIG. 6 after operation.
Figure 8A:
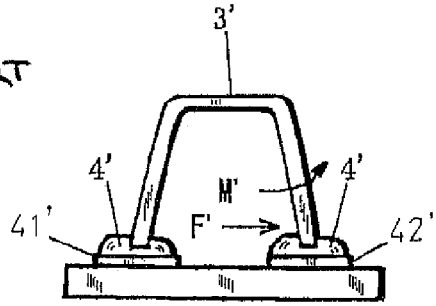
Fig.8A PRIOR ART
FIG. 8 is a view showing a conventional thermoprotector.
Figure 8B:
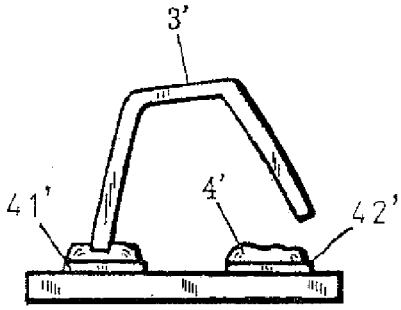
Fig.8B PRIOR ART
Figure 9A:
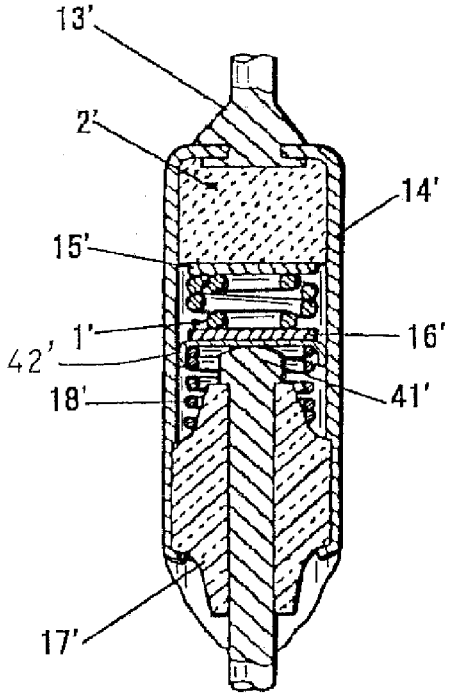
Fig.9A PRIOR ART
FIG. 9 is a view showing another example of a conventional thermoprotector.
Figure 9B:
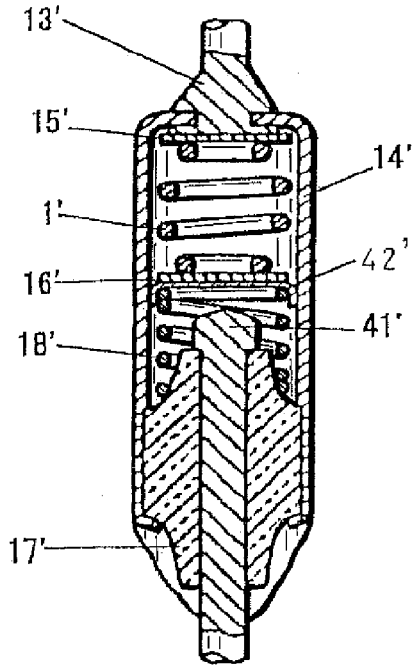
Fig.9B PRIOR ART
Figure 10A:
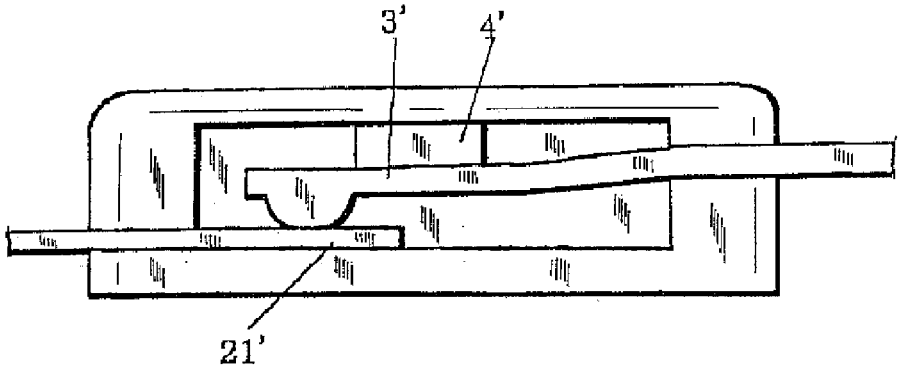
Fig.10A PRIOR ART
FIG. 10 is a view showing a further example of a conventional thermoprotector.
Figure 10B:
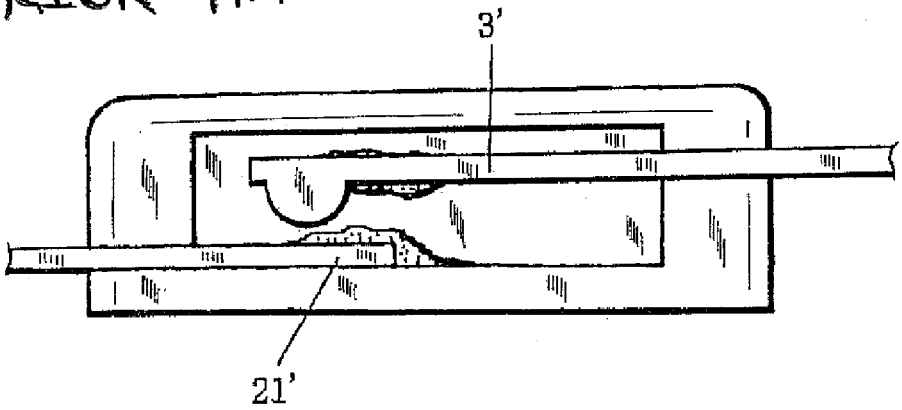
Fig.10B PRIOR ART

The operation of the thermoprotector will be described. Referring to FIG. 6, when the external temperature is raised and the fusible material 4 is heated to the melting point or the softening point, the face joints by the fusible material 4 between the end portions of the elastic movable conductor 3 and the one stationary electrode 21 are liberated by the bending distortion energy of the elastic movable conductor 3. As shown in FIG. 7, the elastic movable conductor 3 is then restored to the original flat plate-like shape to make the bending height of the elastic movable conductor 3 zero. As a result, the contact between the elastic movable conductor 3 and the other stationary electrode 22 is cancelled, and a non-return conduction cut-off operation is conducted.

In this case, the requirement for starting the operation is that the fusible material 4 is melted or softened and the elastic distortion energy of the elastic movable conductor 3 is released. Even when string of the fusible material occurs, therefore, the operation performance is not affected.

The both end portions of the elastic movable conductor 3 which are released from the face joint are housed in a space immediately below the insulation spacer 5, and the elastic movable conductor 3 is prevented from being contacted with the other stationary electrode 22. Therefore, interruption of conduction is surely realized without occurrence of reconduction.

A contact pressure is applied to the contact face between the bending outer face of the elastic movable conductor 3 and the other stationary electrode 22 in (6B) of FIG. 6. This is effective in reduction of the contact resistance. In order to further reduce the contact resistance, the contact face may be bonded by solder which is lower in melting point than the fusible material. In this case, in order to suppress string, the layer of the low-melting point solder is preferably made sufficiently thin.

The thermoprotector shown in FIG. 6 is produced in the following manner. The one stationary electrode is placed on the base of the insulation housing, the elastic movable conductor is placed on the stationary electrode, and the longitudinal load f is applied to the elastic movable conductor to give the bending distortion energy to the elastic movable conductor. In this state, the contact interfaces between the both end portions of the elastic movable conductor and the one stationary electrode are joined and fixed by melting and solidification of the fusible material such as a fusible alloy or a thermoplastic resin. Thereafter, the insulation housing body to which the other stationary electrode and the insulation spacer are attached is bonded to the base of the insulation housing by fusion bonding, an adhesive agent, or fitting, and the other stationary electrode is contacted with the bent top face of the elastic movable conductor, thereby completing the production.

As the elastic movable conductor, for example, phosphor bronze, an Ni or Fe alloy such as elinver, or a high-melting point metal can be used. In the case where a composite material of an elastic resin and a metal is used as the elastic movable conductor, FRP in which a resin (a thermoplastic resin or a thermosetting resin) is reinforced by fibers such as glass fibers, metal fibers, or synthetic fibers, high-rigidity engineering plastic, or the like can be selected in consideration of relative relationships with the melting point of a thermoplastic resin used as the fusible material. As the elastic movable conductor, a composite material of an elastic metal material and a synthetic resin, such as a laminated member of a phosphor bronze plate and a polyamide film may be used.

As a resin used as a constituting member of the elastic movable conductor, and a thermoplastic resin as the fusible material, resins of a predetermined melting point can be selected from: engineering plastics such as polyethylene terephthalate, polyethylene naphthalate, polyamide, polyimide, polybutylene terephthalate, polyphenylene oxide, polyethylene sulfide, and polysulfone; engineering plastics such as polyacetal, polycarbonate, polyphenylene sulfide, polyoxybenzoyl, polyether ether ketone, and polyetherimide; polypropylene; polyvinyl chloride; polyvinyl acetate; polymethyl methacrylate; polyvinylidene chloride; polytetrafluoroethylene; ethylene-polytetrafluoroethylene copolymer; ethylene-vinyl acetate copolymer (EVA); AS resin; ABS resin; ionomer; AAS resin; ACS resin; etc.

As a fusible alloy used as the fusible material, it is preferable to use an alloy which does not contain an element harmful to the biological system, such as Pb or Cd. A composition which can realize a melting point suitable to the operating temperature of the thermoprotector can be selected, for example, from: [A] compositions of In—Sn—Bi alloys such as (1) 43%<Sn≦70%, 0.5%≦In≦10%, and the balance Bi, (2) 25%≦Sn≦40%, 50%≦In≦55%, and the balance Bi, (3) 25%<Sn≦44%, 55%<In≦74%, and 1%≦Bi<20%, (4) 46%<Sn≦70%, 18%≦In<48%, and 1%≦Bi≦12%, (5) 5%≦Sn≦28%, 15%≦In<37%, and the balance Bi (excluding a range of Bi±2%, In and Sn±1% with respect to Bi 57.5%, In 25.2%, and Sn 17.3%, and Bi 54%, In 29.7%, and Sn 16.3%), (6) 10%≦Sn≦18%, 37%≦In≦43%, and the balance Bi, (7) 25%<Sn≦60%, 20%≦In<50%, and 12%<Bi≦33%, (8) a composition in which 0.01 to 7 weight parts of a total of one or two or more of Ag, Au, Cu, Ni, Pd, Pt, Sb, Ga, Ge, and P are added to 100 weight parts of any one of (1) to (7), (9) 33%≦Sn≦43%, 0.5%≦In≦10%, and the balance Bi, (10) a composition in which 3 to 5 weight parts of Bi are added to 100 weight parts of 47%≦Sn≦49% and 51%≦In≦53%, (11) 40%≦Sn≦46%, 7%≦Bi≦12%, and the balance In, (12) 0.3%≦Sn≦1.5%, 51%≦In≦54%, and the balance Bi, (13) 2.5%≦Sn≦10%, 25%≦Bi≦35%, and the balance In, (14) a composition in which 0.01 to 7 weight parts of a total of one or two or more of Ag, Au, Cu, Ni, Pd, Pt, Sb, Ga, Ge, and P are added to 100 weight parts of any one of (9) to (13), and (15) a composition in which 0.01 to 7 weight parts of a total of one or two or more of Ag, Au, Cu, Ni, Pd, Pt, Sb, Ga, Ge, and P are added to 100 weight parts of 10%≦Sn≦25%, 48%≦In≦60%, the balance Bi; [B] compositions of Bi—Sn—Sb alloys such as (16) 30%≦Sn≦70%, 0.3%≦Sb≦20%, the balance Bi, and (17) a composition in which 0.01 to 7 weight parts of a total of one or two or more of Ag, Au, Cu, Ni, Pd, Pt, Ga, Ge, and P are added to 100 weight parts of (16); [C] compositions of In—Sn alloys such as (18) 52%≦In≦85% and the balance Sn, and (19) a composition in which 0.01 to 7 weight parts of a total of one or two or more of Ag, Au, Cu, Ni, Pd, Pt, Sb, Ga, Ge, and P are added to 100 weight parts of (18); [D] compositions of In—Bi alloys such as (20) 45%≦Bi≦compositions of In—Bi alloys such as (20) 45%≦Bi≦55% and the balance In, and (21) a composition in which 0.01 to 7 weight parts of a total of one or two or more of Ag, Au, Cu, Ni, Pd, Pt, Sb, Ga, Ge, and P are added to 100 weight parts of (20); [E] compositions of Bi—Sn alloys such as (22) 50%<Bi≦56% and the balance Sn, and (23) a composition in which 0.01 to 7 weight parts of a total of one or two or more of Ag, Au, Cu, Ni, Pd, Pt, Ga, Ge, and P are added to 100 weight parts of (22); [F] In alloys such as (24) a composition in which 0.01 to 7 weight parts of a total of one or two or more of Au, Bi, Cu, Ni, Pd, Pt, Ga, Ge, and P are added to 100 weight parts of In, (25) a composition in which 0.01 to 7 weight parts of a total of one or two or more of Au, Bi, Cu, Ni, Pd, Pt, Ga, Ge, and P are added to 100 weight parts of 90%≦In≦99.9% and 0.1%≦Ag≦10%, and (26) a composition in which 0.01 to 7 weight parts of a total of one or two or more of Au, Bi, Cu, Ni, Pd, Pt, Ga, Ge, and P are added to 100 weight parts of 95%≦In≦99.9% and 0.1%≦Sb≦5%; and (27) a composition in which 0.01 to 7 weight parts of a total of one or two or more of Au, In, Cu, Ni, Pd, Pt, Ga, Ge, and P are added to 100 weight parts of 2%≦Zn≦15%, 70%≦Sn≦95%, the balance Bi, and the alloy.

When the fusible alloy contains a large amount of a metal having a crystal structure of b.c.c., c.p.h., or the like, plastic deformation is suppressed, and the creep strength can be improved.

As the stationary electrodes, a conductive metal or a conductive alloy such as nickel, copper or a copper alloy can be used, and plating may be applied as required.

What is claimed is:

1. A thermoprotector having:

an insulation housing;

stationary electrodes which are opposed to each other in said insulation housing;

an elastic movable conductor which is placed between said stationary electrodes, one end of said elastic movable conductor being fixed to one of said stationary electrodes, said elastic movable conductor being compressed in a longitudinal direction and elastically curved to cause a middle of said elastic movable conductor to be contacted with another one of said stationary electrodes, another end portion of said elastic movable conductor being face joined by a fusible material to said one stationary electrode against a reaction force of the longitudinal direction compression; and an insulation spacer which is disposed in said insulation housing, said insulation spacer forming a space for housing said other end portion of said elastic movable conductor when said elastic movable conductor is elastically released by melting of said fusible material.

2. A thermoprotector having:

an insulation housing;

stationary electrodes which are opposed to each other in said insulation housing;

an elastic movable conductor which is placed between said stationary electrodes, said elastic movable conductor being compressed in a longitudinal direction and elastically curved to cause a middle of said elastic movable conductor to be contacted with another one of said stationary electrodes, both end portions of said elastic movable conductor being face joined by a fusible material to one of said stationary electrodes against a reaction force of the longitudinal direction compression; and an insulation spacer which is disposed in both ends of an interior of said insulation housing, said insulation spacer forming a space for housing said end portions of said elastic movable conductor when said elastic movable conductor is elastically released by melting of said fusible material.

3. A thermoprotector having:

an insulation housing;

a stationary electrode which is placed in said insulation housing;

an elastic movable conductor which is a tip end portion of a lead wire, and which is opposed to said stationary electrode in said insulation housing, said elastic movable conductor being compressed in a longitudinal direction and elastically curved to cause a middle of said elastic movable conductor to be contacted with said stationary electrode, a tip end portion of said elastic movable conductor being face joined by a fusible material to said stationary electrode against a reaction force of the longitudinal direction compression; and an insulation spacer which is disposed in both ends of an interior of said insulation housing, said insulation spacers forming a space for housing said tip end portion of said elastic movable conductor when said elastic movable conductor is elastically released by melting of said fusible material.

4. A thermoprotector according to claim 1, wherein said insulation spacer has a hole notch which receives a curved deformed portion of said fusible material, and an outer circumference of said insulation spacer is in close proximity to an inner circumference of said insulation housing.

5. A thermoprotector according to claim 2, wherein said insulation spacer has a hole notch which receives a curved deformed portion of said fusible material, and an outer circumference of said insulation spacer is in close proximity to an inner circumference of said insulation housing.

6. A thermoprotector according to claim 3, wherein said insulation spacer has a hole notch which receives a curved deformed portion of said fusible material, and an outer circumference of said insulation spacer is in close proximity to an inner circumference of said insulation housing.

7. A thermoprotector according to claim 1, wherein said fusible material is a fusible alloy.

8. A thermoprotector according to claim 2, wherein said fusible material is a fusible alloy.

9. A thermoprotector according to claim 3, wherein said fusible material is a fusible alloy.

10. A thermoprotector according to claim 4, wherein said fusible material is a fusible alloy.

11. A thermoprotector according to claim 5, wherein said fusible material is a fusible alloy.

12. A thermoprotector according to claim 6, wherein said fusible material is a fusible alloy.

13. A thermoprotector according to claim 1, wherein said fusible material is a thermoplastic resin.

14. A thermoprotector according to claim 2, wherein said fusible material is a thermoplastic resin.

15. A thermoprotector according to claim 3, wherein said fusible material is a thermoplastic resin.

16. A thermoprotector according to claim 4, wherein said fusible material is a thermoplastic resin.

17. A thermoprotector according to claim 5, wherein said fusible material is a thermoplastic resin.

18. A thermoprotector according to claim 6, wherein said fusible material is a thermoplastic resin.

19. A thermoprotector according to claim 1, wherein said elastic movable conductor is a single elastic metal, a composite material of an elastic metal and a resin, or a composite material of an elastic resin and a metal.

20. A thermoprotector according to claim 2, wherein said elastic movable conductor is a single elastic metal, a composite material of an elastic metal and a resin, or a composite material of an elastic resin and a metal.

21. A thermoprotector according to claim 3, wherein said elastic movable conductor is a single elastic metal, a composite material of an elastic metal and a resin, or a composite material of an elastic resin and a metal.

22. A thermoprotector according to claim 4, wherein said elastic movable conductor is a single elastic metal, a composite material of an elastic metal and a resin, or a composite material of an elastic resin and a metal.

23. A thermoprotector according to claim 5, wherein said elastic movable conductor is a single elastic metal, a composite material of an elastic metal and a resin, or a composite material of an elastic resin and a metal.

24. A thermoprotector according to claim 6, wherein said elastic movable conductor is a single elastic metal, a composite material of an elastic metal and a resin, or a composite material of an elastic resin and a metal.

25. A thermoprotector according to claim 7, wherein said elastic movable conductor is a single elastic metal, a composite material of an elastic metal and a resin, or a composite material of an elastic resin and a metal.

26. A thermoprotector according to claim 8, wherein said elastic movable conductor is a single elastic metal, a composite material of an elastic metal and a resin, or a composite material of an elastic resin and a metal.

27. A thermoprotector according to claim 9, wherein said elastic movable conductor is a single elastic metal, a composite material of an elastic metal and a resin, or a composite material of an elastic resin and a metal.

28. A thermoprotector according to claim 10, wherein said elastic movable conductor is a single elastic metal, a composite material of an elastic metal and a resin, or a composite material of an elastic resin and a metal.

29. A thermoprotector according to claim 11, wherein said elastic movable conductor is a single elastic metal, a composite material of an elastic metal and a resin, or a composite material of an elastic resin and a metal.

30. A thermoprotector according to claim 12, wherein said elastic movable conductor is a single elastic metal, a composite material of an elastic metal and a resin, or a composite material of an elastic resin and a metal.

31. A thermoprotector according to claim 13, wherein said elastic movable conductor is a single elastic metal, a composite material of an elastic metal and a resin, or a composite material of an elastic resin and a metal.

32. A thermoprotector according to claim 14, wherein said elastic movable conductor is a single elastic metal, a composite material of an elastic metal and a resin, or a composite material of an elastic resin and a metal.

33. A thermoprotector according to claim 15, wherein said elastic movable conductor is a single elastic metal, a composite material of an elastic metal and a resin, or a composite material of an elastic resin and a metal.

34. A thermoprotector according to claim 16, wherein said elastic movable conductor is a single elastic metal, a composite material of an elastic metal and a resin, or a composite material of an elastic resin and a metal.

35. A thermoprotector according to claim 17, wherein said elastic movable conductor is a single elastic metal, a composite material of an elastic metal and a resin, or a composite material of an elastic resin and a metal.

36. A thermoprotector according to claim 18, wherein said elastic movable conductor is a single elastic metal, a composite material of an elastic metal and a resin, or a composite material of an elastic resin and a metal.

* * * * *